US007892015B2

(12) United States Patent
Li et al.

(10) Patent No.: US 7,892,015 B2
(45) Date of Patent: Feb. 22, 2011

(54) ELECTRICAL CONNECTOR ASSEMBLY WITH IMPROVED LATCHING MECHANISM

(75) Inventors: Dong-Sheng Li, Kunshan (CN); Su-Feng Liu, Kunshan (CN); Chin-Te Lai, Tu-Cheng (TW); Bin Xu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/729,830

(22) Filed: Mar. 23, 2010

(65) Prior Publication Data

US 2010/0240243 A1 Sep. 23, 2010

(30) Foreign Application Priority Data

Mar. 23, 2009 (CN) ..... 2009 2 0301532

(51) Int. Cl.
*H01R 13/62* (2006.01)

(52) U.S. Cl. ..... 439/358

(58) Field of Classification Search ..... 439/358, 439/357

See application file for complete search history.

(56) References Cited

U.S. PATENT DOCUMENTS 5,167,523 A * 12/1992 Crimmins et al. ..... 439/350
5,741,150 A * 4/1998 Stinson et al. ..... 439/358
5,860,826 A * 1/1999 Chang ..... 439/358
5,941,726 A * 8/1999 Koegel et al. ..... 439/358
6,322,387 B2 * 11/2001 Kawamae et al. ..... 439/358
6,371,788 B1 * 4/2002 Bowling et al. ..... 439/358
6,585,536 B1 * 7/2003 Wu ..... 439/358
6,736,663 B2 * 5/2004 Lee et al. ..... 439/358
6,991,487 B2 1/2006 Wu
7,422,457 B1 9/2008 Wu
2001/0004563 A1 * 6/2001 Kawamae et al. ..... 439/357
2002/0072267 A1 * 6/2002 Bowling et al. ..... 439/358
2003/0228788 A1 * 12/2003 Igarashi et al. ..... 439/358
2004/0137779 A1 * 7/2004 Wei ..... 439/358
2005/0026492 A1 * 2/2005 Zhang et al. ..... 439/358

* cited by examiner

*Primary Examiner*—Gary F. Paumen
(74) *Attorney, Agent, or Firm*—Wei Te Chung; Andrew C. Cheng; Ming Chieh Chang

(57) ABSTRACT

An electrical connector assembly (100) comprises a housing (1) defining a pair of receiving spaces and a receiving room (10) therein and a pair of slits (13) formed at two sides of the housing and respectively communicated with the receiving space. The housing defines a pair of inclined ribs (123, 115) therein, the pair of receiving spaces and the receiving room are spaced from each other by the pair of the ribs. And a pair of latches (2) are respectively received into corresponding receiving space and engaged with the pair of inclined ribs of the housing, each latch having a base portion (21) received into a receiving space, a latching portion (22) extending outwardly and passing through the slit, a pressing portion (23) extending inwardly and rearwardly from a rear end of the base portion and disposed out of the housing, an elastic portion (24) extending inwardly from the base portion and attached to a side surface of the rib and an engaging portion (25) disposed at a front end of the latch and engaged with the rib.

16 Claims, 4 Drawing Sheets

ELECTRICAL CONNECTOR ASSEMBLY WITH IMPROVED LATCHING MECHANISM

FIELD OF THE INVENTION

The present invention relates to an electrical connector assembly, and more particularly to an electrical connector assembly used for high-speed transmission.

DESCRIPTION OF PRIOR ART

SFP (Small Form-factor Pluggable), X-SFP and QSFP are all modules for fiber optic transmission or signal transmission. All of the modules are of small size or form factor which is important. The smaller the form factor of the module, the less space taken on a printed circuit board to which it couples. A smaller form factor allows a greater number of modules to be coupled onto a printed circuit board to support additional communication channels. However, the smaller form factor makes it more difficult for a user to handle.

When such a module embedded in a system fails to work, it is desirable to replace it, particularly when other communication channels are supported by other modules. To replace a failed module, it needs to be pluggable into a module receptacle. While, plugging in a new module is usually easy, it is more difficult to remove the failed module because of other components surrounding it. Additionally, a user should not attempt to pull on cables of the module in order to try and remove a failed module or else the user might cause damage thereto.

Therefore, designers developed different solutions to solve above problems accounted by the users, such as disclosed by U.S. Pat. Nos. 6,851,867, 6,749,448, 6,884,097, 6,908,323, 7,052,306, 6,824,416 and 7,090,523. The theories of theses patents are substantially the same, that is each module is received in corresponding cage or module receptacle and comprises a pair of sliders with forward ends engaging with tabs of the cage, and a bail or lever capable of rotating to actuate the sliders linearly to separate forward ends of the sliders from the tabs. The action theory of theses patents successfully solve the problems mentioned above. However, the latch mechanisms disclosed above all need springs to serve as spring back means to actuate the latch mechanisms to return to original positions. Further, the plug modules are arranged side by side to mate with module receptacles. There is little space left for operator to pull bail or levers to separate the modules from the module receptacles. The present invention provides a plug module with an improved latch mechanism operating in a theory different from that of these patents while still successfully solving the problems.

As discussed above, an improved electrical connector assembly overcoming the shortages of existing technology is needed.

SUMMARY OF THE INVENTION

Accordingly, an object of the present invention is to provide an electrical connector assembly with an improved latching mechanism for latching to and releasing from the receptacle connector conveniently, and occupied a smaller space around the electrical connector assembly.

In order to achieve the above-mentioned objects, an electrical connector assembly comprises a housing defining a pair of receiving spaces and a receiving room therein and a pair of slits formed at two sides of the housing and respectively communicated with the receiving space. The housing defines a pair of inclined ribs therein, the pair of receiving spaces and the receiving room are spaced from each other by the pair of the ribs. And a pair of latches are respectively received into corresponding receiving space and engaged with the pair of inclined ribs of the housing, each latch has a base portion received into a receiving space, a latching portion extending outwardly and passing through the slit, a pressing portion extending inwardly and rearwardly from a rear end of the base portion and disposed out of the housing, an elastic portion extending inwardly from the base portion and attached to a side surface of the rib and an engaging portion disposed at a front end of the latch and engaged with the rib.

Other objects, features and advantages of the invention will be apparent from the following detailed description taken in connection with the accompanying drawings.

DETAILED DESCRIPTION OF PREFERRED EMBODIMENTS

Figure 1:
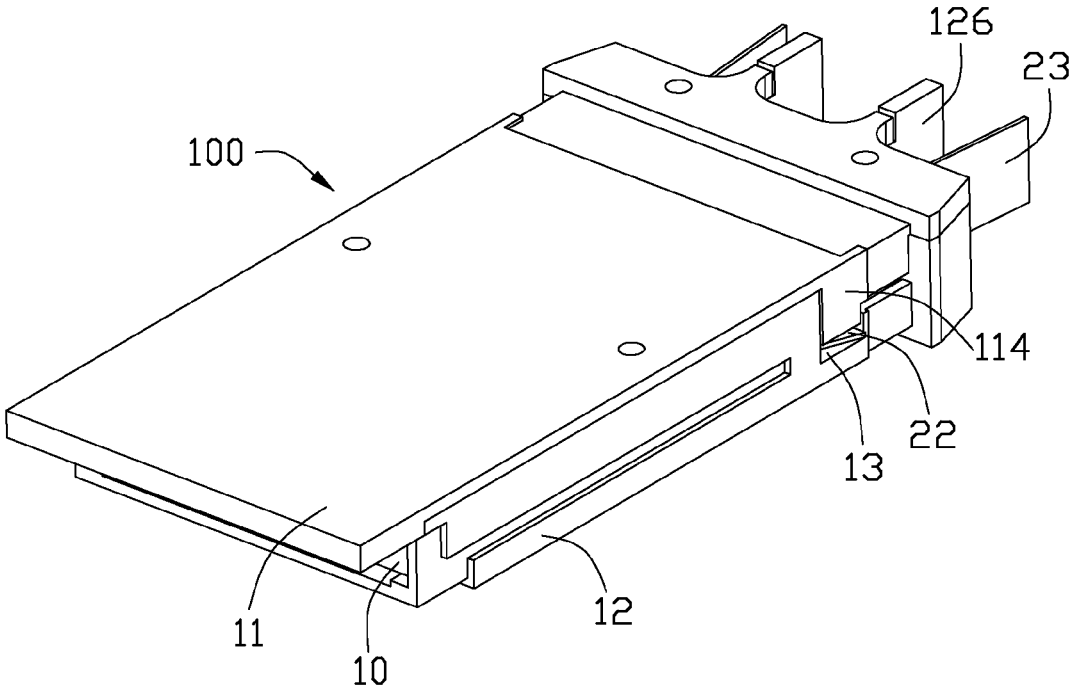
FIG. 1 is a perspective view of an electrical connector assembly in accordance with the present invention.

Reference will now be made to the drawing figures to describe the present invention in detail.

Referring to FIGS. 1 to 4, an electrical connector assembly 100 in accordance with the present invention comprises a die cast housing 1 and a latching mechanism assembled to the housing 1. And the electrical connector assembly 100 further has a printed circuit board (not shown) received into the housing 1 and a cable (not shown) electrically connected with a rear end of the printed circuit board and extending out of the housing 1. The latching mechanism includes a pair of latches 2 disposed at two sides of the housing 1.

Referring to FIGS. 1 to 4, the housing 1 includes an upper cover 11 and a lower cover 12 assembled with each other. The upper cover 11 and a lower cover 12 are all die-cast to provide EMI protection. The housing 1 defines a receiving room 10 for receiving a printed circuit board (not shown) and a front portion of a cable (not shown) electrically connected to the printed circuit board. The housing 1 defines a front opening (not figured) and a rear opening (not figured) respectively formed on a front and a rear surface thereof. The front and rear opening respectively communicates with the receiving room 10 and allows the receiving room 10 communicating with an exterior.

Figure 2:
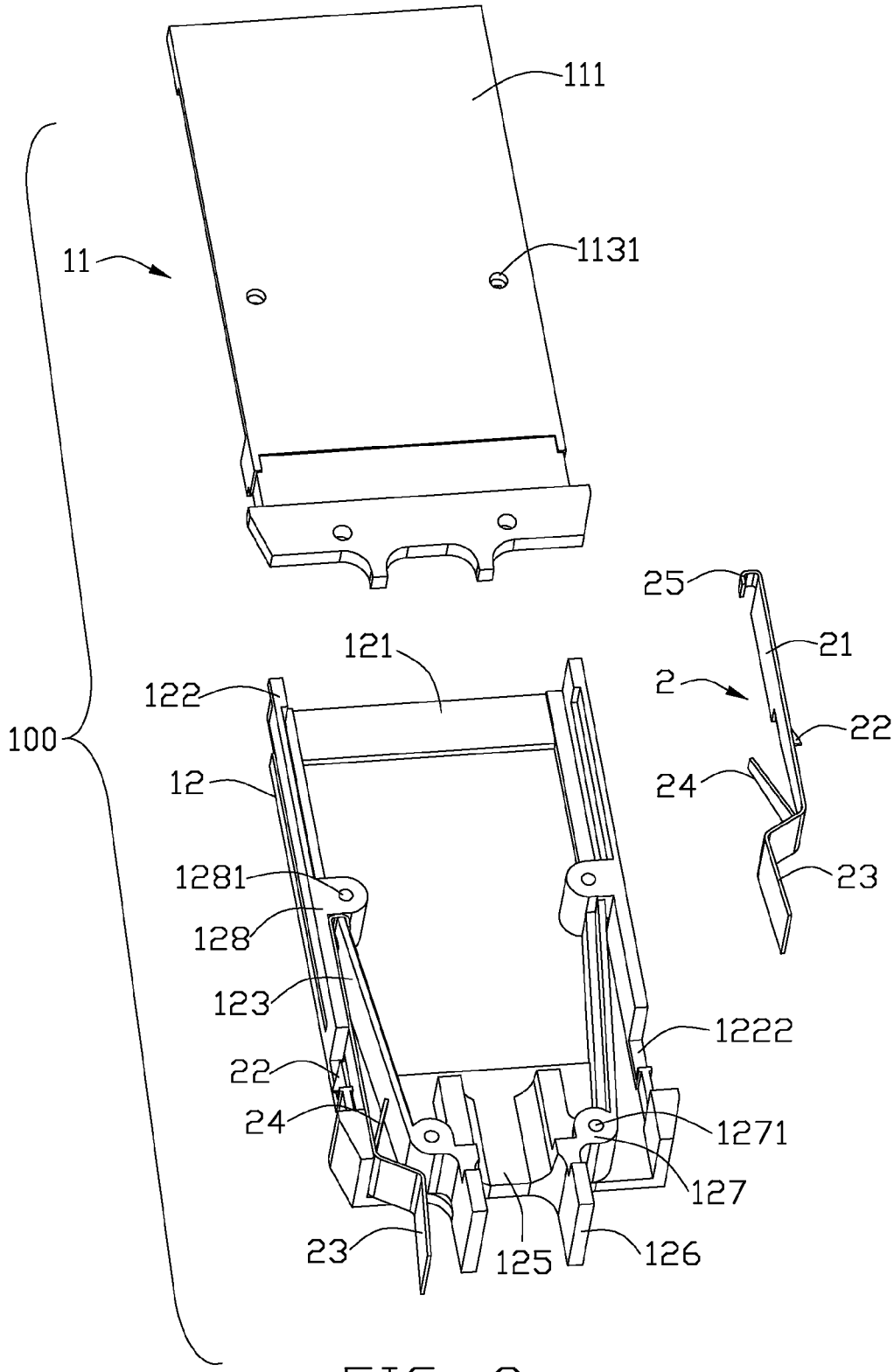
FIG. 2 is a partially assembled, perspective view of the electrical connector assembly of FIG. 1.
Figure 3:
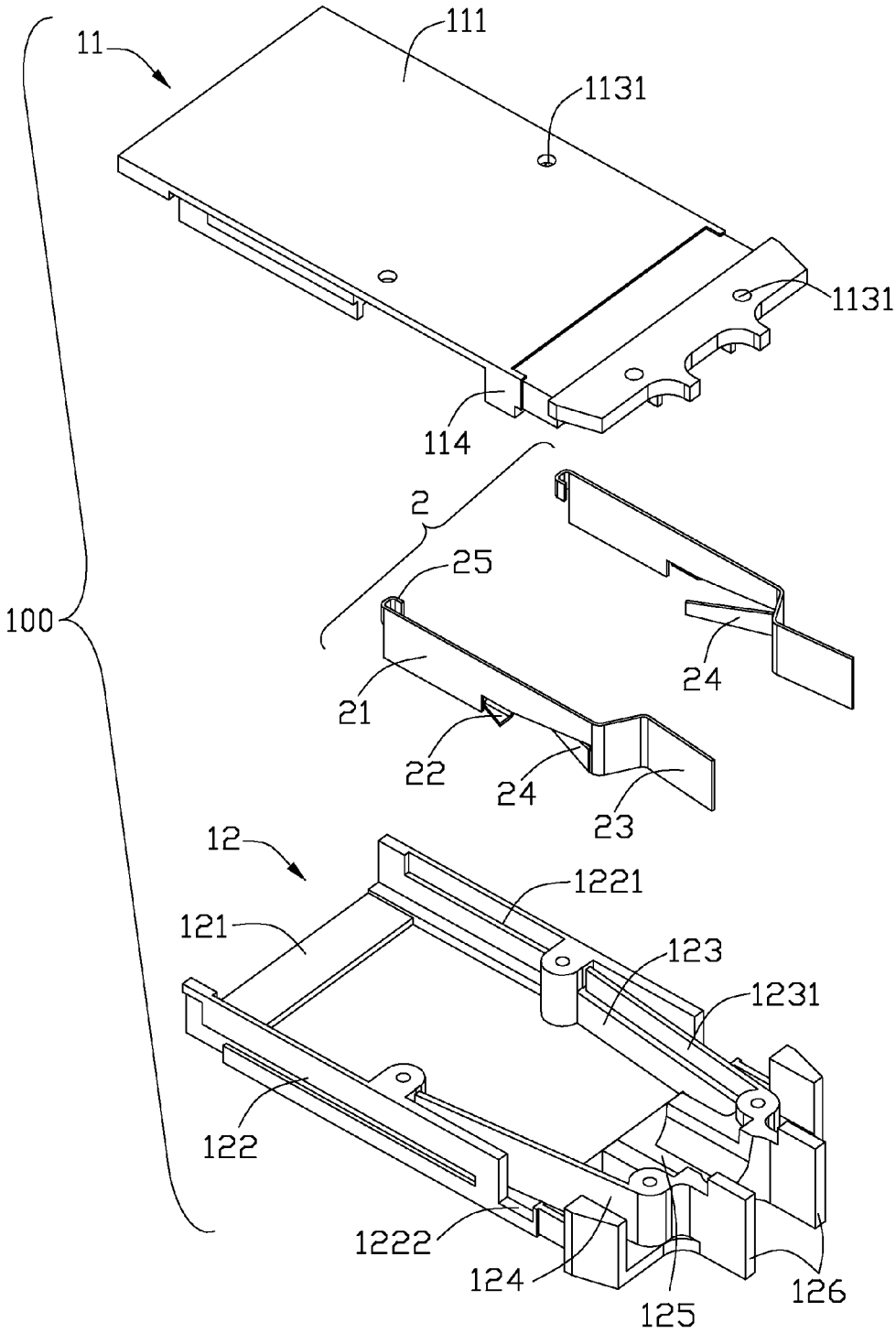
FIG. 3 is an exploded, perspective view of the electrical connector assembly of FIG. 1.
Figure 4:
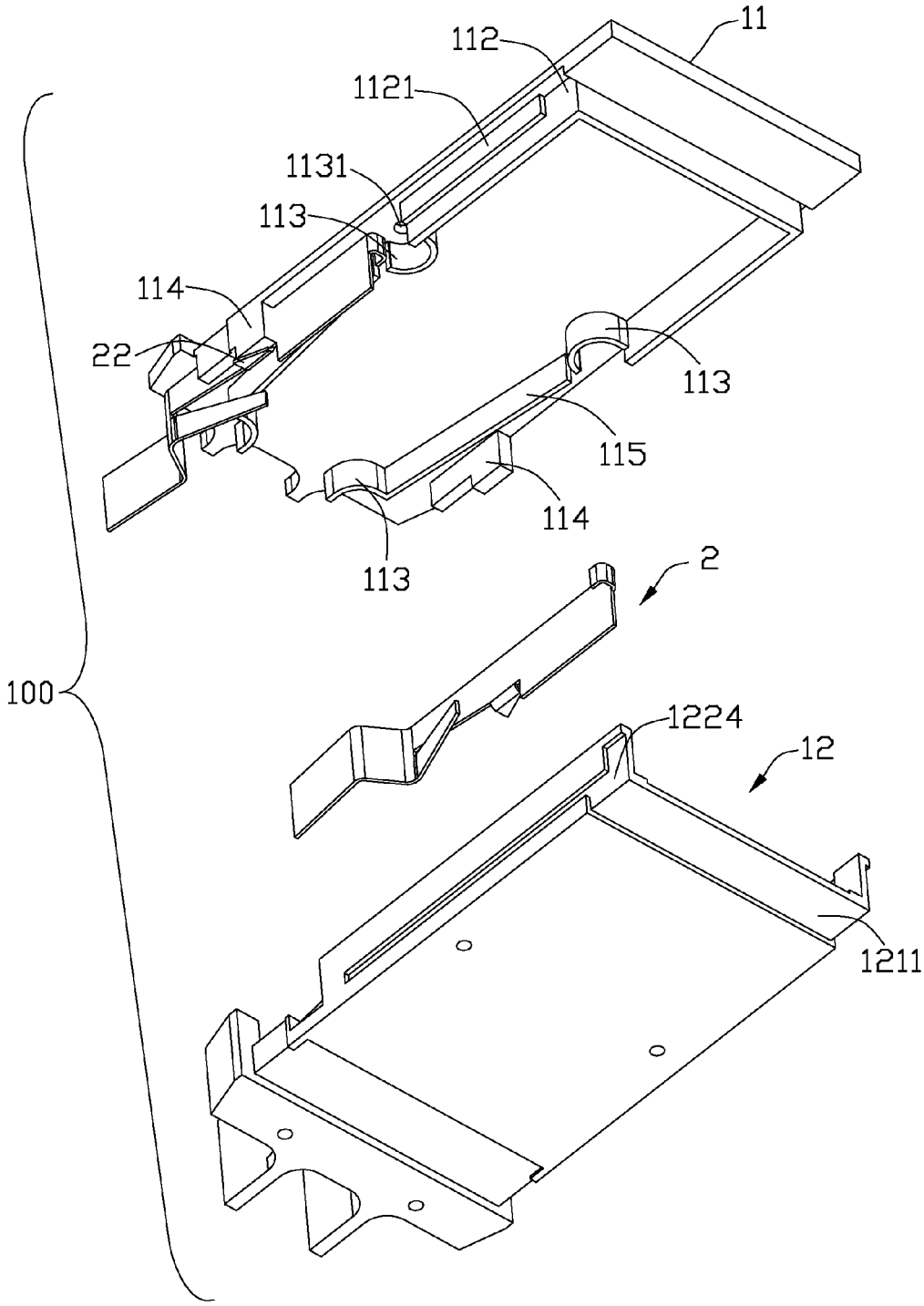
FIG. 4 is similar to FIG. 2, but viewed from another aspect.

Referring to FIGS. 2 to 4, the lower cover 12 includes a bottom wall 121, a pair of second side walls 122 extending upwardly from two sides of the bottom wall 121, and a pair of inclined second ribs 123 extending upwardly from a top surface of the bottom wall 121. Each second side wall 122 defines a cutout 1222 at a rear end thereof. And, the pair of second ribs 123 are both disposed between the two second side walls 122. Two rear ends of the pair of second ribs 123 are gradually closed with each other. Each second rib 123 is angled with a second side wall 122 to form a trigonal receiving slot 124. In addition, each second rib 123 also defines a first long and narrow slot 1231 extending along a direction of the second rib 123 and communicated with the trigonal receiving slot 124 at a front end of the second rib 123. A rectangular groove 1211 is formed on a front end of a bottom surface of the bottom wall 121. The lower cover 12 further defines a pair of first positioning posts 128 formed on the top surface of the bottom wall 121. Each first positioning post 128 communicates with an inner face of the second side wall 122 and a front free end of the second rib 123. Thus, the second side wall 122 and second rib 123 are connected with each other through the first positioning post 128. Each first positioning post 128 defines a receiving hole 1281. A long recess 1221 is formed on an inner surface of each side wall 122. A L-shaped guiding slot 1224 is formed on an outer surface of each side wall 122 and communicated with the rectangular groove 1211. A channel 125 is formed on a rear end of the lower cover 12 and used for supporting and receiving the cable. The lower cover 12 also defines two spaced blocking plates 126 disposed at a rear end of the lower cover 12. A pair of second positioning posts 127 are also formed on a top surface of the bottom wall 121. A rear end of second rib 123 is connected with a front end of the plate 126 through the second positioning post 127. Each second positioning post 127 defines a second receiving hole 1271.

Referring to FIGS. 1 to 4, the upper cover 11 defines a top wall 111 and a pair of first side walls 112 extending downwardly from two sides of the top wall 111. Each first side wall 112 defines a protruding portion 1121 extending outwardly from an outer surface thereof. The upper cover 11 further defines a pair of first ribs 115 disposed between the two first side walls 112 and corresponding to the pair of second ribs 123 of the lower cover 12 in a vertical direction. Two pairs of cambered receiving cavities 113 are formed on the upper cover 11 for receiving the first and second positioning posts 128, 127 of the lower cover 12. Two pairs of through holes 1131 are formed on the top wall 111 of the upper cover 11 and corresponding to the first and second receiving holes 1281, 1271 in a vertical direction. And the pair of first ribs 115 are corresponding to the long and narrow slot 1231 of the second rib 123 and can be received into the long and narrow slot 1231 when the upper cover 11 and the lower cover 12 are assembled with each other. The upper cover 11 further defines a pair of protrusions 114 extending downwardly from at two sides of a bottom surface of the top wall 111. Each protrusion 114 can be received into the cutout 1222 of the lower cover 12 when the upper cover 11 and the lower cover 12 are assembled with each other. However, it should be noted that the protrusion 114 will not be full filled into the cutout 1222 when the upper cover 11 and the lower cover 12 engaged with each other.

Referring to FIGS. 1 to 4, the latching mechanism includes a pair of latches 2 respectively formed at two sides of the housing 1. Each latch 2 is stamped and formed from a metallic plate and comprises base portion 21, a pressing portion 23 extending inwardly and rearwardly from a rear end of the base portion 21 and an engaging portion 25 formed at a front end of the latch 2. The latch 2 further defines an inclined elastic portion 24 extending inwardly and forwardly from a rear end of the base portion 21 and a latching portion 22 extending outwardly for latching with the complementary connector (not shown). An angle (not figured) is formed between the latching portion 22 and the base portion 21. The engaging portion 25 of the latch 2 is a barb.

Referring to FIGS. 1 to 4, the assembling process of the electrical connector assembly 100 made in according to the present invention starts from assembling the pair of latches 2 to the lower cover 12. As a result, the base portion 21 of each latch 2 is received into the trigonal receiving slot 124 and attached to an inner surface of a side wall 122 of the lower cover 12. The engaging portion 25 is engaged with a front end of the second rib 123 to make the latch 2 assembled to the lower cover 12. A free end of the inclined elastic portion 24 attaches to the second rib 123 and angled with the second rib 123, and a free end of the latching portion 22 extends laterally to an exterior through the cutout 1222 of the second side wall 122 for latching with the complementary connector. The pressing portion 23 extends beyond a rear surface of the housing 1 and is spaced apart with the blocking plate 126.

After the pair of latches 2 are assembled to the housing 1, then assembling the printed circuit board (not shown) and the cable (not shown) electrically connected to the printed circuit board to the lower cover 12 together along an up to down direction.

After the print circuit board and the cable are assembled to the housing 1, then assembling the upper cover 11 to the lower cover 12. As a result, the pair of protruding portions 1121 are respectively received into the two long recesses 1221. The pair of protrusions 114 are received into the cutout 1222 to make the upper cover 11 and lower cover 12 engaged with each other in a front to rear direction. In addition, the pair of first ribs 115 are received into the long and narrow slot 1231, and the first and second positioning posts 128, 127 are received into the cambered receiving cavities 113.

Finally, assembling four screws (not shown) to the housing 1 in an up to down direction. Thus, the upper cover 11 and the lower cover 12 are engaged with each other in a up to down direction. Then, the housing 1 is formed by the upper cover 11 and the lower cover 12. The housing 1 defines two side walls, and each side wall is formed by a first side wall 112 of the upper cover 11 and a second side wall 122 of the lower cover 12. A pair of slits 13 are respectively formed at two side walls of the housing 1 for a pair of latching portions 22 of latches 2 passing through. A pair of receiving slots 124 formed in the lower cover 12 are both covered by the upper cover 11 in a vertical direction. So, a pair of receiving space (not figured) are formed in the housing 1 for receiving the pair of latches 2. A pair of ribs (not figured) are formed in the housing 1. Each rib is formed by a first rib 115 and a second rib 123. The receiving room 10 and the pair of the receiving space (not figured) are spaced from each other by the pair of the ribs (115, 123).

When the electrical connector assembly 100 is needed to mate with the complementary connector, the operator only exerts an inward force to the two pressing portions 23 of the pair of latches 2. Thus, the latching portion 22 will be moved inwardly and received into the receiving slot 124, the free end of the elastic portion 24 will be slid forwardly along an outer side surface of the second rib 123. In addition, as the blocking plate 126 existed, a further inward movement of the pressing portion 23 will be limited. When the electrical connector assembly 100 is fully mated with the complementary connector, the operator can release the two pressing portions 23 of the pair of latches 2. As a result, each latch 2 will be resumed to an original state through an elastic outward force, the latching portion 22 will extend to an exterior and lock with the complementary connector. It should be noted that the elastic outward force is an counterforce from the second rib 123 exerted to the elastic portion 24 of the latch 2. If the electrical connector assembly 100 will be removed from the complementary connector, the operator exerts an inward force to the two pressing portions 23 of the pair of latches 2, then pulls the electrical connector assembly out of the complementary connector. Obviously, the pair of latches 2 have a new structure and are easily and conveniently operated by the user.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. An electrical connector assembly, comprising:

a housing defining a pair of receiving spaces and a receiving room therein and a pair of slits formed at two sides of the housing and respectively communicated with the pair of receiving spaces, the housing defining a pair of inclined ribs therein, the pair of receiving spaces and the receiving room spaced from each other by the pair of ribs; and a pair of latches respectively received into the corresponding receiving space and engaged with the pair of inclined ribs of the housing, each latch having a base portion received into a receiving space, a latching portion extending outwardly and passing through the slit, a pressing portion extending inwardly and rearwardly from a rear end of the base portion and disposed out of the housing, an elastic portion extending inwardly from the base portion and attached to a side surface of the rib and an engaging portion disposed at a front end of the latch and engaged with the rib.

2. The electrical connector assembly as recited in claim 1, wherein the housing comprises an upper cover and a lower cover engaged with each other.

3. The electrical connector assembly as recited in claim 2, wherein the lower cover defines a bottom wall, a pair of second walls and a pair of blocking plates extending rearwardly from a rear end of the bottom, and the upper cover defines a top wall and a pair of first side walls cooperating with the pair of second walls.

4. The electrical connector assembly as recited in claim 3, wherein the lower cover defines a plurality of positioning posts, each positioning post has a receiving hole, and the upper cover defines a plurality of through holes corresponding to the receiving holes in a vertical direction.

5. The electrical connector assembly as recited in claim 3, wherein the lower cover defines a pair of first ribs, and the upper cover defines a pair of second ribs cooperating with the pair of first ribs.

6. The electrical connector assembly as recited in claim 3, wherein the lower cover defines a pair of long recesses respectively formed on an inner surface of the second side wall, and the upper cover defines a pair of protruding portions respectively received into the corresponding pair of long recesses.

7. The electrical connector assembly as recited in claim 3, wherein lower cover further defines a pair of blocking plates disposed at a rear end thereof and the pair of pressing portions are respectively located at two sides of the pair of blocking plates.

8. The electrical connector assembly as recited in claim 3, wherein the lower cover defines a pair of cutouts respectively formed on the pair of second side walls, and the upper cover defines a pair of protrusions received into the corresponding cutouts.

9. The electrical connector assembly as recited in claim 4, wherein the upper cover defines a plurality of receiving cavities, and the plurality of positioning posts are respectively received into the receiving cavities.

10. An electrical connector assembly, comprising:

a metallic housing comprising a pair of receiving spaces extending forwardly from a rear surface of the housing and a receiving room therein, a pair of slits formed at two sides of the housing and respectively communicated with the pair of receiving spaces, the pair of receiving spaces and the receiving room respectively spaced with each other by a pair of ribs formed in the housing; and a pair of latches assembled to the housing, each latch defining a base portion received into the receiving space, a pressing portion disposed at a rear end of the latch and extending out of the housing, an elastic portion extending inwardly and forwardly and having a front end attached to a side surface of the rib, an engaging portion disposed at a front end of the latch and engaged with the rib and a latching portion extending outward and passing through the corresponding slit.

11. An electrical connector assembly as recited in claim 10, wherein the engaging portion of the latch is a barb.

12. An electrical connector assembly as recited in claim 10, wherein the housing includes a lower cover and an upper cover engaged with other.

13. An electrical connector assembly as recited in claim 10, wherein the housing defines a pair of blocking plates disposed at a rear end thereof and the pair of pressing portions are respectively located at two sides of the pair of blocking plates.

14. An electrical connector assembly as recited in claim 10, the housing defines a plurality receiving hole for receiving a plurality screws.

15. An electrical connector assembly comprising:

a housing defining an interior center receiving room with a mating port and a plurality of contacts therein;

a pair of side receiving spaces located by two sides of the center receiving room;

a cable extending rearwardly from the receiving room via a rear opening of the housing;

a pair of blocking plates rearwardly extending from the housing around the rear opening to form a neck portion;

a pair of latches received in the corresponding side receiving spaces, respectively, each of said latches extending in a cantilevered manner and including a fixed front end, a rear pressing portion located beside the corresponding blocking plate, a median latching portion extending outwardly outside of the housing for locking a complementary connector, and an elastic portion to urge the median latching portion outwardly; wherein the pressing portions of the pair of latches are located adjacent to the neck portion for easy operation.

16. The electrical connector assembly as claimed in claim 15, wherein the elastic portion is located between the rear pressing portion and the median latching portion.

* * * * *